US007922517B2

(12) United States Patent
Landis et al.

(10) Patent No.: US 7,922,517 B2
(45) Date of Patent: Apr. 12, 2011

(54) RETAINING SYSTEM AND METHOD FOR PREVENTING THE RELEASE OF WIRES FROM A POKE-IN CONNECTOR

(75) Inventors: John Michael Landis, Camp Hill, PA (US); Timothy Lee Kocher, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 123 days.

(21) Appl. No.: 11/567,018

(22) Filed: Dec. 5, 2006

(65) Prior Publication Data

US 2008/0132109 A1 Jun. 5, 2008

(51) Int. Cl.
*H01R 13/56* (2006.01)

(52) U.S. Cl. ..... 439/445

(58) Field of Classification Search ..... 439/932, 439/794, 796, 797, 798, 439, 441, 440, 749; 174/87, 84 C, 112; 493/439, 441, 440
See application file for complete search history.

(56) References Cited

U.S. PATENT DOCUMENTS

| | | | | | |
|---|---|---|---|---|---|
| 3,205,295 | A * | 9/1965 | Davidson | 174/32 |
| 3,326,442 | A * | 6/1967 | Fattor | 228/56.3 |
| 3,455,022 | A * | 7/1969 | Schmitz, Jr. et al. | 29/859 |
| 4,883,925 | A * | 11/1989 | Graf | 174/84 R |
| 5,378,855 | A * | 1/1995 | Delalle | 174/87 |
| 5,624,274 | A * | 4/1997 | Lin | 439/417 |
| 5,975,939 | A * | 11/1999 | Market | 439/415 |
| 6,156,973 | A * | 12/2000 | Ushiyama et al. | 174/68.3 |
| 6,548,761 | B1 * | 4/2003 | Wang | 174/74 R |
| 6,677,529 | B1 * | 1/2004 | Endacott | 174/84 R |
| 6,833,508 | B2 * | 12/2004 | Cha | 174/135 |
| 7,193,155 | B2 * | 3/2007 | McMillan et al. | 174/112 |

* cited by examiner

*Primary Examiner* — Phuong K Dinh

(57) ABSTRACT

A system and method of preventing an unwanted release of wires from a poke in style connector is disclosed. The system and method are designed to prevent wires that can be removed from connectors by simultaneous twisting and pulling force from being released. The system and method operate by bundling at least two wires together to prevent the wires from rotating proximate to the connector.

7 Claims, 3 Drawing Sheets

RETAINING SYSTEM AND METHOD FOR PREVENTING THE RELEASE OF WIRES FROM A POKE-IN CONNECTOR

FIELD OF THE INVENTION

The present invention is directed to wire retention system and method for preventing wires inserted into electrical connectors from accidentally releasing. The invention also provides for a label to be applied to a wire retention system proximate to the point of insertion into a connector.

BACKGROUND OF THE INVENTION

At present, electrical wires are attached to poke-in connectors by inserting a wire end into an opening of the connector where the wire is engaged by a force to hold or lock the wire into place. The engagement of the wire may be by a lance, spring or other tensioning mechanism within the connector.

These wires may release from the connector if the wire is simultaneously pulled away from the connector and twisted. Thus, connectors that are capable of releasing wires by a pull and twist force may have their wires accidentally released if these forces are applied to the wires unintentionally.

Therefore, there is a need to provide a wire retention system and method to prevent the accidental release of wires from poke-in connectors from simultaneously twisting the wires while the wire is being pulled away from the connector.

SUMMARY OF THE INVENTION

This invention is a retaining system and method for preventing the accidental release of wires from a poke-in connector that may release wires upon simultaneous pulling and twisting of wires therefrom. The system and method performs by bundling at least two wires proximate to the point of insertion into the connector. In this manner, if a pulling force away from the connector is accidentally applied to the wires and the wires are twisted, the wires are unable to rotate relative to the connector and thus prevented from accidental release from the connector. As used herein, the twisting of the wires simultaneously with the pulling in a direction away from the connector occurs around a point lying approximately axially aligned with the path of the wires into the connector.

The connector is a poke-in connector type that secures a stripped lead of a wire by inserting the wire lead into the connector and engaging the wire lead with an engaging mechanism that physically and electrically engages the wire within the connector without soldering. The connector provides an electrical connection to at least one other secured wire.

The system and method may be applied to wires of any diameter, and has shown to be effective for 12 to 20 gauge wire with corresponding diameters of about 0.03 inches to about 0.06 inches, although it is within the scope of the invention to apply the method to wires of lesser or greater diameter. At least two wires are bundled to prevent twisting, but it is within the scope of the invention to bundle any number of wires greater than two.

The wires may be bundled proximate to the connector by several methods. In a first embodiment of the retention system and method, a sleeve is placed around at least two wires proximate to the point where the wires enter the connector. The sleeve is of a sufficient length, applied proximate to the point where the wires enter the connector, and applied in such a manner so as to prevent the wires from rotating relative to the connector at the point where the wires enter the connector when the wires are twisted while being pulled from the connector. The sleeve must be tightly placed around the bundled wires so as to allow little or no relative movement between the wires. In such a manner, the wires are secured and prevented from becoming released from the connector.

For 12 to 20 gauge wire, a sleeve of a length of greater than about 0.5 inches may be applied to two or more wires at a distance of less than about 0.75 inches from the point where the wires enter the connector to prevent the wires form becoming disconnected from the connector. The sleeve is preferably located from about 0.25 inches to about 0.75 inches from where the wires enter the connector. A sleeve length of greater than about 0.5 inches may be used. A sleeve length of between about 0.5 inches and 0.75 inches is preferred.

The sleeve may be formed of any wrapping material capable of remaining tightly bound to the wires while a twisting force is applied to the wires. Suitable wrapping materials included shrink wrap tubing and wire label tape.

The sleeve may be formed of a shrink wrap material such as polyvinyl chloride (PVC), a high temperature fluoropolymer, a polyolefin, and neoprene. For example, the tubing may be a flexible polyolefin tubing such as ShrinkMark produced by Tyco Electronics Corporation of Middletown, Pa.

The sleeve may also be formed of a wire label tape formed of polyester, vinyl, and polyamide. For example the wire label tape may be a thermal transfer printable clear polyester film with permanent acrylic adhesive such as CP Clear Polyester produced by Tyco Electronics Corporation of Middletown, Pa.

In a second embodiment of the invention, the wires may be bundled by a wire tie. The wire tie must be tightly placed around the bundled wires so as to allow little or no relative movement between the wires. The wire tie may be formed of a polyamide such as Nylon or other similar material. The wire tie is formed with an end receiver for receiving the other end of the wire tie and ribbing along the wire tie such that when the free end is passed through the receiver end, the wire tie may be ratcheted down tight around the wires. The wire tie may be ratcheted down by hand or by a tightening device. More than one wire tie may be applied adjacent or in close proximity to increase the axial length of coverage along the wires. The wire tie may be a polyamide cable tie such as AMP-TY Nylon Cable Ties in about 0.2 width produced by Tyco Electronics Corporation of Middletown, Pa.

Wire ties have a greater stiffness compared to the above disclosed sleeves due to the greater thickness of the wire tie. The width of the wire tie is analogous to the length of the wire sleeve, both measured as the axial coverage of the wires. Because of the increased stiffness, the wire tie may provide less axial coverage of the wires compared to the wire sleeve. Specifically, a wire tie with a width of about 0.05 or greater may be applied less than about 0.75 inches from the point where the wires enter the connector to prevent the wires from rotating relative to the connector proximate to the point where the wires enter the connector. In such a manner, the wires will be prevented from releasing from the connector when the wires are twisted while pulled from the connector. A wire tie with a width of about 0.1 inches to about 0.5 inches is preferred. A wire tie may be placed less than 0.75 inches from the point where the wires enter the connector, and are preferably placed less than about 0.5 inches from the point where the wires enter the connector.

In a third embodiment of the invention, at least two wires are twisted around one another proximate to the point where the wires enter the connector. The wires are twisted in such a manner so as to prevent the wires from rotating relative to the connector proximate to the point where the wires enter the connector. For two or more wires, the wires may be twisted around one another or braided so as to prevent rotation. For 12 to 20 gauge wire, wires that have been twisted 2 or more times around one another from less than about 0.75 inches from the point where the wires enter the connector have secured the wires from being disconnected from a connector when being pulled and twisted from the connector.

In a fourth embodiment of the invention, a label, mark or color is incorporated into the wrapping material so as to allow identifying or description terms or symbols to be applied to the wires proximate to the point where the wires enter the connector. The label may be incorporated into the wrapping material prior to application to the wires or may be incorporated or printed upon the wrapping material after the wrapping material has been applied to the wires. For example, wire label tape with preprinted information may be a thermal transfer printable clear polyester film with permanent acrylic adhesive such as CP Clear Polyester produced by Tyco Electronics Corporation of Middletown, Pa.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawing, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
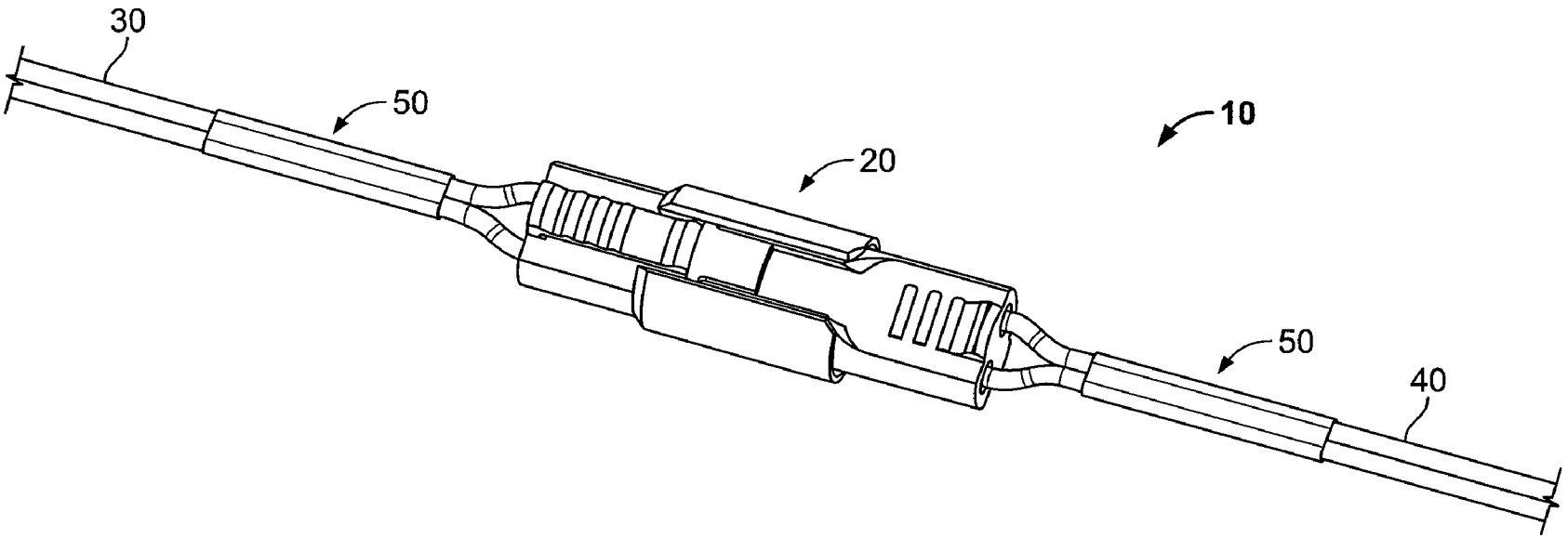
FIG. 1 illustrates an embodiment of the wire retaining system and method of the current invention.

Referring to FIG. 1, according to the first embodiment of the invention, a retaining system 10 for preventing the accidental release of two or more wires from a poke-in connector 20 is shown. The retaining system 10 includes a poke-in connector 20 for electrically connecting wires, input wires 30, output wires 40, and a pair of wire bundling sleeves 50. The input wires 30 and output wires 40 are formed of 18 gauge wire.

A first wire bundling sleeve 50 was placed around the input wires 30. A second wire bundling sleeve 50 was placed around the output wires 40. The sleeves were formed of 0.5 inches lengths of polyolefin tubing manufactured under the name ShrinkMark produced by Tyco Electronics Corporation of Middletown, Pa. The sleeves were slid over the wires and heated to shrink the sleeve securely around the wires. Both sleeves 50 were placed approximately 0.5 inches from the point where the input wires 30 and output wires 40 enter the connector 20.

The sleeves 50 prevented the input wires 30 and the output wires 40 from substantially rotating proximate to the point where the wires enter the connector 20 when the wires were twisted while a pulling force was applied to the wires and prevented the input wires 30 and the output wires 40 from becoming disconnected from the wire connector 20.

In accordance with a second embodiment of the invention, wire ties were placed around the input and output wires as in the first embodiment. In this embodiment, the wire ties were AMP-TY Nylon Cable Ties in 0.236 width produced by Tyco Electronics Corporation of Middletown, Pa. The wire ties were placed about 0.5 inches from the point where the wires entered the connector.

The wire ties prevented the input and output wires from substantially rotating proximate to the point where the wires enter the connector when the wires were twisted while a pulling force was applied to the wires and prevented the input and output wires from becoming disconnected from the wire connector.

Figure 2:
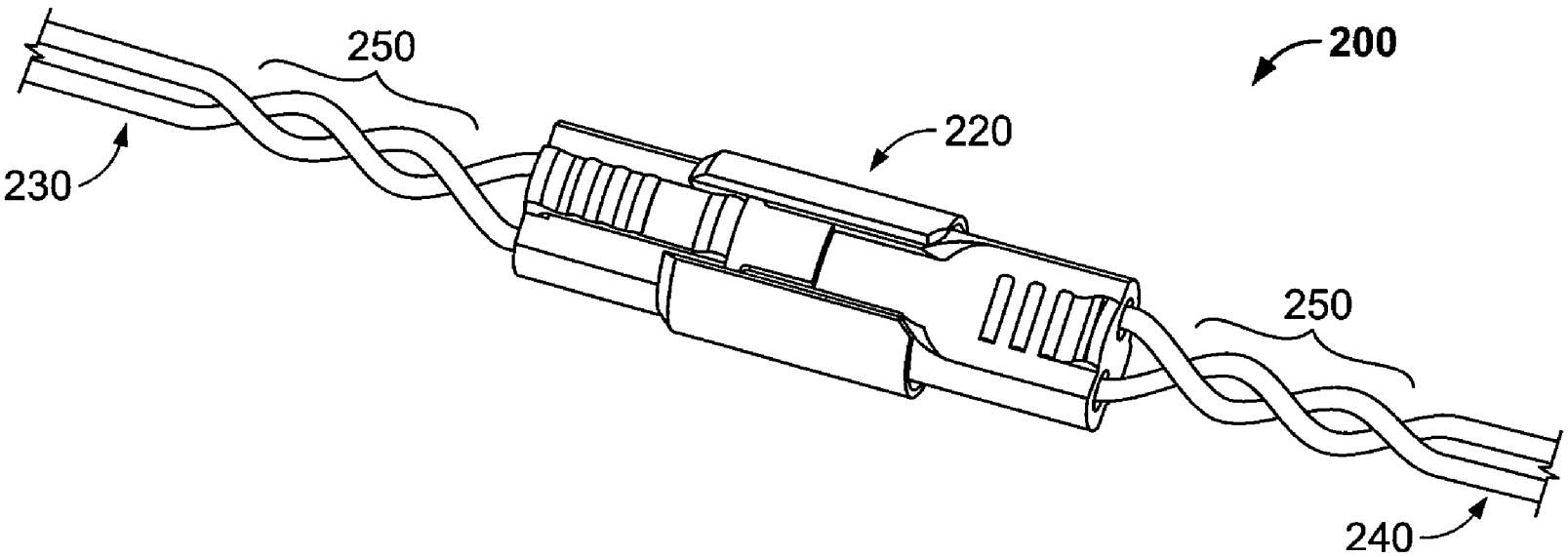
FIG. 2 illustrates a second embodiment of the wire retaining system and method of the current.

A third embodiment of the invention is illustrated in FIG. 2. As shown in FIG. 2, a second retaining system 200 was formed of a poke in connector 220, input wires 230, output wires 240, and wire twist sections 250. The input wires 230 were prevented from disconnecting from the connector 220 by the wire twist section 250. The wire twist section 250 bundled the input wires 230 and output wires 240 proximate to a point where the wires entered the connector 220. The wire twist section 250 was formed by twisting two 18 gauge wires that formed the input wires 230 around one another twice proximate to the point where the input wires 230 entered the connector 220. The other wire twist section 250 was formed by twisting two 18 gauge wires that formed the output wires 230 proximate to the point where the output wires 240 entered the connector 220.

The wire twist sections prevented the input wires 230 and output wires 240 from substantially rotating proximate to the point where the wires enter the connector when the wires were twisted while a pulling force was applied to the wires and prevented the input wires 230 and the output wires 240 from becoming disconnected from the connector 220.

Figure 3:
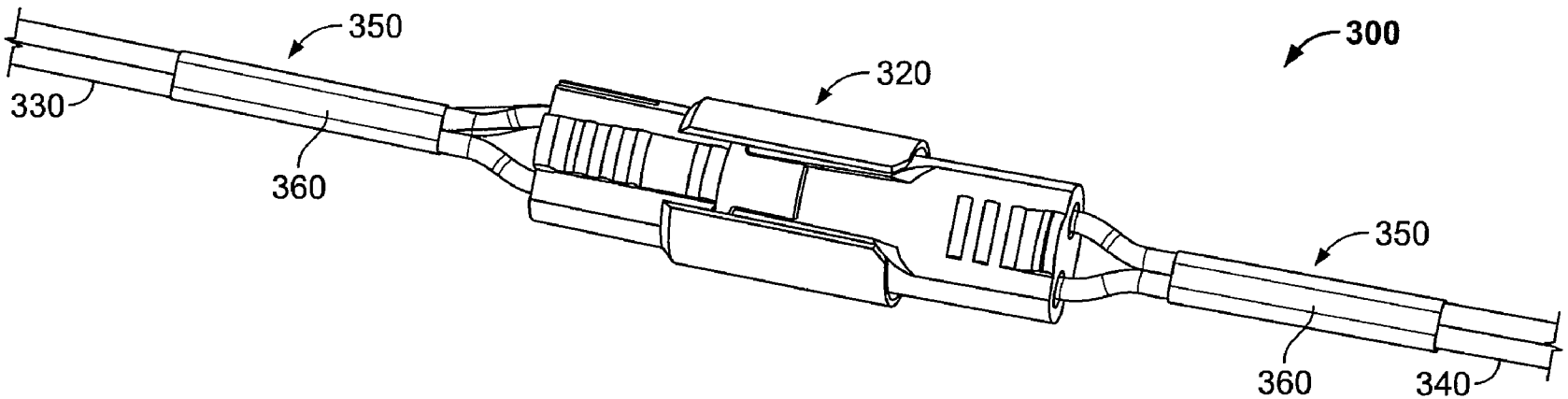
FIG. 3 illustrates a third embodiment of the current invention incorporating a label into the wire retaining system and method.

A fourth embodiment of the invention is shown in FIG. 3. As illustrated in FIG. 3, a third retaining system 300 was formed of a poke-in connector 320, input wires 330, output wires 340, and a pair of wire bundling sleeves 350. A wire bundling sleeve 350 was placed around the input wires 330 and another wire bundling sleeve 350 was placed around the output wires 340 to prevent the wires form disconnecting from the connector 320 when the wires 340 are pulled in a direction away from the connector 320 while simultaneously twisted. The sleeve 350 incorporated an identifier 360 to mark the wires 330 that have been bundled. The identifier 360 was a label.

In this embodiment, the bundling sleeve 350 was formed of shrink wrap tubing incorporating the identifier 360 formed of a polyolefin tubing manufactured under the name ShrinkMark produced by Tyco Electronics Corporation of Middletown, Pa. The shrink wrap tubing forming the sleeve 350 was formed around the wires 330 by conventional sliding the sleeve 350 over the wires and heating with a heat gun until the shrink wrap tubing tightly bundled the wires. The sleeves 350 were approximately 0.5 inches long and prevented the wires from substantially rotating at the point where the wires enter the connector 320 and prevented the input wires 330 and the output wires 340 from becoming disconnected from the connector 320.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A wire retention system, comprising:

a poke-in connector;

at least two wires connected to the poke-in connector; and a separate sleeve positioned at a distance greater than zero and at less than about 0.75 inches from a point where the wires enter the poke-in connector to prevent the wires from substantially rotating at the point where the wires enter the poke-in connector and releasing from the poke-in connector;

wherein the separate sleeve is selected from the group comprising shrink wrap tubing and wire label tape and has a width of between about 0.05 inches and about 0.5 inches.

2. The wire retention system of claim 1 wherein the separate sleeve is selected from a group comprising shrink wrap tubing, wire label tape and wire ties.

3. The wire retention system of claim 1, wherein the separate sleeve is about 0.5 inches wide.

4. The wire retention system of claim 3, further comprising an identifier incorporated into the separate sleeve.

5. The wire retention system of claim 4, wherein the at least two wires are 18 gauge wires.

6. The wire retention system of claim 4, wherein the identifier is incorporated into the separate sleeve prior to the sleeve being placed around the wires.

7. The wire retention system of claim 1, wherein the separate sleeve is positioned at a distance of about 0.5 inches from the point where the wires enter the poke-in connector.

* * * * *